US011320216B2

(12) United States Patent
Cho

(10) Patent No.: US 11,320,216 B2
(45) Date of Patent: May 3, 2022

(54) INSERT FOR EVAPORATOR HEADER

(71) Applicant: Hamilton Sundstrand Corporation, Charlotte, NC (US)

(72) Inventor: Wei-Lin Cho, Unionville, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 64 days.

(21) Appl. No.: 16/775,644

(22) Filed: Jan. 29, 2020

(65) Prior Publication Data

US 2021/0231390 A1 Jul. 29, 2021

(51) Int. Cl.

| | |
|---|---|
| ***F28F 9/02*** | (2006.01) |
| ***F25B 39/02*** | (2006.01) |
| *B05B 1/34* | (2006.01) |

(52) U.S. Cl.

CPC ..... *F28F 9/028* (2013.01); *F25B 39/028* (2013.01); *F28F 9/0246* (2013.01); *F28F 9/0282* (2013.01); *B05B 1/3447* (2013.01); *F28F 9/0243* (2013.01)

(58) Field of Classification Search

CPC ..... F25B 39/02; F25B 39/028; F25B 41/30; F28F 9/0282; F22B 37/74; B05B 1/3405; B05B 1/3415; B05B 1/3447; B05B 1/3442

See application file for complete search history.

(56) References Cited

U.S. PATENT DOCUMENTS 1,527,740 A * 2/1925 Lipshitz ..... F24H 1/107 126/350.1
2,707,868 A * 5/1955 Goodman ..... F25B 39/02 62/196.4
3,628,734 A * 12/1971 Lindell ..... A23N 17/005 239/403
4,869,313 A 9/1989 Fredley
6,263,678 B1 7/2001 Suttrop
(Continued)

FOREIGN PATENT DOCUMENTS

CN 2780284 Y 5/2006
CN 101737218 A * 6/2010
(Continued)

OTHER PUBLICATIONS

European Search Report Issued in European Application No. 21154297.2-1002 dated Jun. 16, 2021; 11 Pages.

*Primary Examiner* — Eric S Ruppert
(74) *Attorney, Agent, or Firm* — Cantor Colburn LLP

(57) ABSTRACT

Disclosed is an evaporator header insert, including: a header insert body that extends along a body center axis between body inlet and outlet ends, a center passage located within the header insert body, the center passage extending from the body inlet end to the body outlet end along the body center axis, the center passage surface defining: a center passage inlet portion at the body inlet end; a center passage outlet portion, at the body outlet end, that defines a body nozzle portion on the body center axis, wherein the body nozzle portion has a convergent-divergent shape so that the body nozzle portion has a convergent segment, a divergent segment and a neck segment therebetween; and a conical tip member, fixed to the body outlet end and disposed at least partially within the divergent segment of the body nozzle portion so that a conical outlet passage is formed therebetween.

9 Claims, 7 Drawing Sheets

(56) References Cited

U.S. PATENT DOCUMENTS

| | | | | |
|---|---|---|---|---|
| 6,958,107 | B1 | 10/2005 | Clarke et al. | |
| 2008/0217483 | A1 | 9/2008 | Hugon et al. | |
| 2009/0038321 | A1* | 2/2009 | Lefor | F25B 39/028 62/117 |

FOREIGN PATENT DOCUMENTS

| | | | | | |
|---|---|---|---|---|---|
| CN | 107362561 | A | | 11/2017 | |
| CN | 110124893 | A | | 8/2019 | |
| DE | 930872 | C | * | 7/1955 | F25B 41/30 |
| GB | 280817 | A | * | 11/1927 | F24F 6/12 |
| GB | 1496115 | A | | 12/1977 | |
| JP | 2011231972 | A | * | 11/2011 | |
| RU | 2580727 | C1 | | 4/2016 | |

* cited by examiner

INSERT FOR EVAPORATOR HEADER

BACKGROUND

The embodiments herein relate to an evaporator for evaporating a single-phase liquid or two-phase fluid in a refrigerant system and more specifically to an insert for an evaporator header of the evaporator.

A distributor, e.g., a header, in refrigeration systems receives single-phase liquid or two-phase refrigerant flow and divides it equally to provide uniform feed to all passages of an evaporator. Each passage of an evaporator in a refrigeration system should have an equal fluid mass flow rate of refrigerant in order for the refrigeration system to effectively to use the evaporator. In addition, the header is used to reduce flow from a larger area within the header to a smaller area in the individual evaporator paths. In the case of removing heat from a large footprint area, the evaporator will be designed to have multiple parallel flow passages which allows the working fluid to be vaporized with reasonable pressure drop and temperature uniformity. In a parallel flow passage design, a flow distribution is a factor determining the overall evaporator performance. Under adverse gravity conditions of the type encountered in aerospace applications, characteristics of the flow dynamics into the evaporator passages from the header may result in reduced contact between the working fluid and the evaporator. This may reduce effectiveness of the system.

BRIEF SUMMARY

Disclosed is a header insert for an evaporator header outlet port of an evaporator header, including: a header insert body that extends along a body center axis between a body inlet end and a body outlet end, wherein the header insert body includes a center passage defined by a center passage surface located within the header insert body, the center passage surface extending from the body inlet end to the body outlet end along the body center axis, the center passage surface defining: a center passage inlet portion at the body inlet end; a center passage outlet portion at the body outlet end, the center passage outlet portion defining a body nozzle portion on the body center axis, the body nozzle portion having a convergent-divergent shape so that the body nozzle portion has a convergent segment, a divergent segment and a neck segment therebetween; and a conical tip member, fixed to the body outlet end and disposed at least partially within the divergent segment of the body nozzle portion so that a conical outlet passage is formed therebetween.

In addition to one or more of the above disclosed aspects or as an alternate, a divergent segment diameter is defined by the divergent segment, the divergent segment diameter sized so that the divergent segment defines an axial outer edge of the body outlet end.

In addition to one or more of the above disclosed aspects or as an alternate, a conical tip member base portion is defined by the conical tip member, the conical tip member base portion having a base portion diameter that is larger than a center passage diameter; and the base portion diameter of the conical tip member is smaller than the divergent segment diameter.

In addition to one or more of the above disclosed aspects or as an alternate, the header insert further includes: one or more runners that connect the conical tip member to the body outlet end.

In addition to one or more of the above disclosed aspects or as an alternate, the header insert further includes a flange that extends radially outwardly from the header insert from a location that is axially between the body inlet end and the body outlet end; wherein the center passage outlet portion of the center passage surface is axially between the flange and the body outlet end.

Further disclosed is an evaporator assembly including a header insert having one or more of the above disclosed aspects and further including: the evaporator header that defines the evaporator header outlet port; an evaporator body that defines an evaporator passage in fluid communication with the evaporator header outlet port, and wherein the header insert is inserted into the evaporator header outlet port.

Further disclosed is a method of directing fluid through an evaporator assembly, including: directing a fluid into a center passage inlet portion of a center passage surface of a header insert from an evaporator header outlet port of an evaporator header; directing the fluid into a center passage outlet portion at a body outlet end of the center passage surface, the center passage outlet portion defining a body nozzle portion on a body center axis, the body nozzle portion having a convergent-divergent shape so that the body nozzle portion has a convergent segment, a divergent segment and a neck segment therebetween; directing the fluid into a conical outlet passage formed between the divergent segment of the body nozzle portion and a conical tip member fixed to the body outlet end of the header insert; and directing the fluid into an evaporator passage of an evaporator body from the conical outlet passage, wherein the fluid moves towards a sidewall of the evaporator passage and moves downstream along the evaporator passage.

Further disclosed is an internal insert for a header insert of an evaporator header outlet port, including: an internal insert tip portion; an internal insert base portion spaced along a body center axis from the internal insert tip portion; and an internal insert center body portion extending axially between the internal insert tip portion and the internal insert base portion, wherein: the internal insert tip portion converges away from the internal insert center body portion; the internal insert center body portion defines a first axial segment and a second axial segment extending away from one another, wherein the first axial segment extends to the internal insert tip portion and the second axial segment extends to the internal insert base portion; and a helical fluid passage surface, defining a continuous helical fluid passage, is formed into the internal insert center body portion.

In addition to one or more of the above disclosed aspects or as an alternate, the first axial segment defines a first axial segment diameter that is substantially constant and the second axial segment is formed to taper conically from the first axial segment to the internal insert base portion.

In addition to one or more of the above disclosed aspects or as an alternate, the internal insert further includes a ring segment defined by the internal insert base portion, the ring segment having a ring segment outer dimeter that is larger than the first axial segment diameter.

In addition to one or more of the above disclosed aspects or as an alternate, the internal insert further includes a plurality of ribs formed by the internal insert base portion, the plurality of ribs being circumferentially spaced apart from one another and extend radially inwardly to connect the ring segment to the internal insert, thereby defining a plurality of fluid inlet ports circumferentially spaced apart from one another, the plurality of fluid inlet ports being configured to guide fluid therethrough toward the helical fluid passage surface along the second axial segment of the internal insert center body portion.

In addition to one or more of the above disclosed aspects or as an alternate, a first radial through-hole is formed through the internal insert base portion, wherein the first radial through-hole is configured to receive a fixing pin for fixing the internal insert to the header insert.

Further disclosed is an internal insert having one or more of the above disclosed aspects in combination with a header insert, wherein the header insert includes: a header insert body that extends along the body center axis between a body inlet end and a body outlet end, wherein the header insert body includes a center passage surface defining a center passage that extends from the body inlet end to the body outlet end along the body center axis, the center passage surface defining: a center passage inlet portion at the body inlet end; a center passage outlet portion at the body outlet end, the center passage outlet portion defining a body nozzle portion on the body center axis, the body nozzle portion having a convergent-divergent shape so that the body nozzle portion has a convergent segment, a divergent segment and a neck segment therebetween; wherein the internal insert is configured for being disposed within the center passage, so that the internal insert tip portion is disposed at the convergent segment of the body nozzle portion and the internal insert base portion is at the center passage inlet portion of the center passage surface.

In addition to one or more of the above disclosed aspects or as an alternate, a radial outward step is formed at the body outlet end of the header insert, wherein the radial outward step is configured for seating against the internal insert base portion, thereby limiting axial motion of the internal insert within the header insert.

In addition to one or more of the above disclosed aspects or as an alternate, a second radial through-hole is formed by the body outlet end of the header insert, wherein when the internal insert is within the header insert, a first radial through-hole in the internal insert and the second radial through-hole are aligned with one another and configured for receiving a fixing pin.

In addition to one or more of the above disclosed aspects or as an alternate, a length defined by the internal insert, along the body center axis, is substantially the same as the center passage surface, between the body outlet end and the neck segment of the body nozzle portion.

In addition to one or more of the above disclosed aspects or as an alternate, the internal insert is configured for a clearance fit within the center passage.

In addition to one or more of the above disclosed aspects or as an alternate, the internal insert in combination with the header insert further includes: an evaporator header that defines the evaporator header outlet port; an evaporator body that defines an evaporator passage in fluid communication with the evaporator header outlet port, wherein the header insert is disposed in the evaporator header outlet port.

Further disclosed is a method of directing fluid through an evaporator assembly, including: directing a fluid along a center passage surface of a header insert from an evaporator header outlet port of an evaporator header; directing the fluid along an internal insert base portion of an internal insert disposed with a center passage; directing the fluid along a helical fluid passage surface formed into an internal insert center body portion of the internal insert; directing the fluid between an internal insert tip portion and a convergent segment of a center passage outlet portion of the center passage surface; directing the fluid through a neck segment of a body nozzle portion of the center passage surface; directing the fluid out of a divergent segment of the body nozzle portion of the center passage surface; and directing the fluid into an evaporator passage of an evaporator body from the center passage outlet portion of the center passage surface, wherein the fluid moves towards a sidewall of the evaporator passage and moves downstream along the evaporator passage.

In addition to one or more of the above disclosed aspects or as an alternate, directing the fluid through the internal insert base portion includes directing the fluid through a plurality of fluid inlet ports circumferentially spaced apart from one another, defined by a plurality of ribs that are circumferentially spaced apart from one another and that connect a ring segment of the internal insert base portion to the internal insert.

BRIEF DESCRIPTION OF THE DRAWINGS

The present disclosure is illustrated by way of example and not limited in the accompanying figures in which like reference numerals indicate similar elements.

DETAILED DESCRIPTION

Aspects of the disclosed embodiments will now be addressed with reference to the figures. Aspects in any one figure is equally applicable to any other figure unless otherwise indicated. Aspects illustrated in the figures are for purposes of supporting the disclosure and are not in any way intended on limiting the scope of the disclosed embodiments. Any sequence of numbering in the figures is for reference purposes only.

Figure 1:
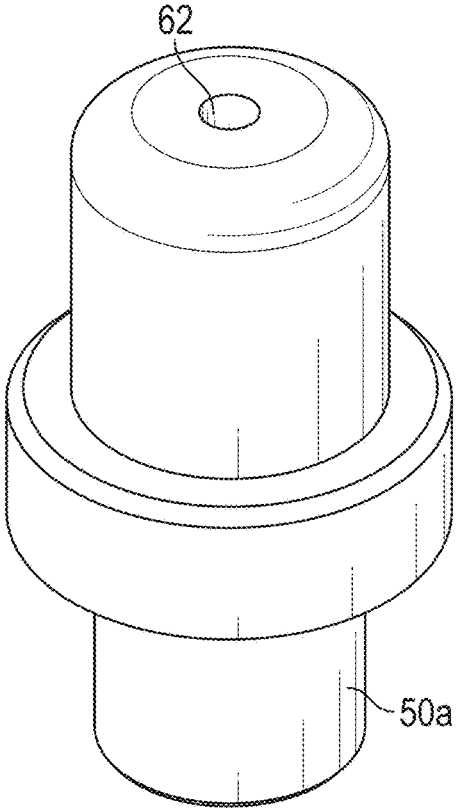
FIG. 1 (Prior Art)
FIG. 1 is an isometric view of a prior art insert for an evaporator.
Figure 2:
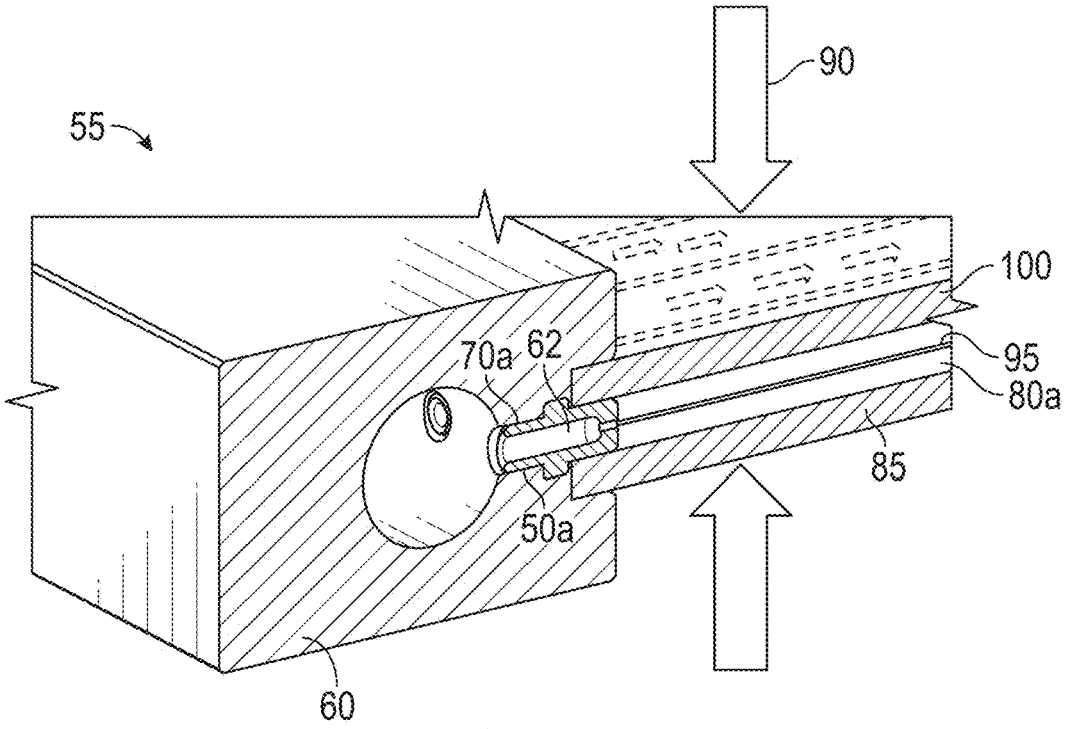
FIG. 2 (Prior Art)
FIG. 2 is a cross sectional view of an evaporator equipped with the insert of FIG. 1.
Figure 4:
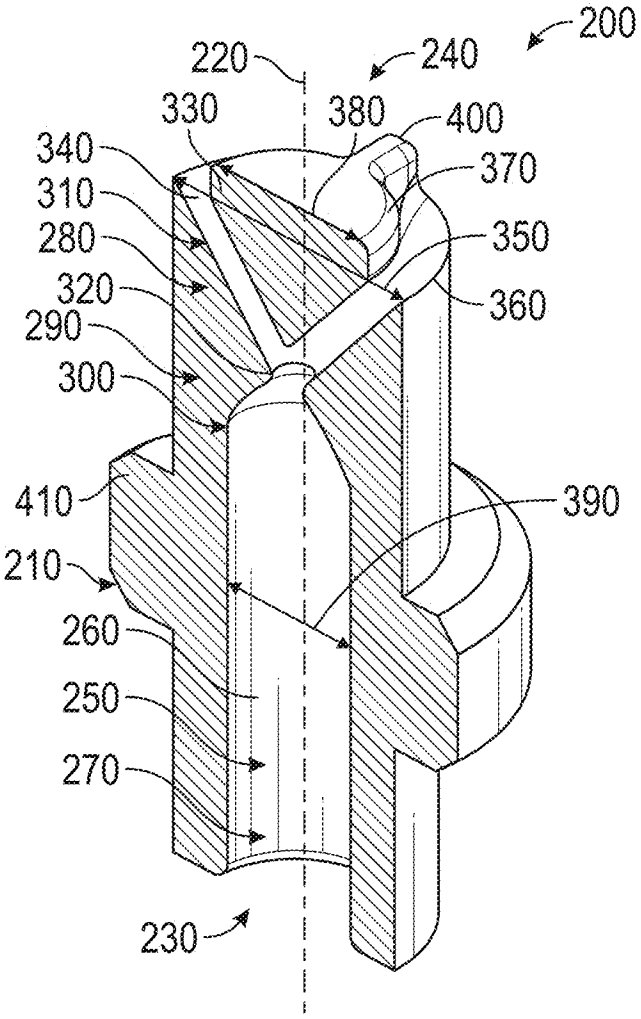
FIG. 4 is a cross-sectional view of the evaporator header insert of FIG. 3 taken along lines A-A in FIG. 3, according to an embodiment.
Figure 3:
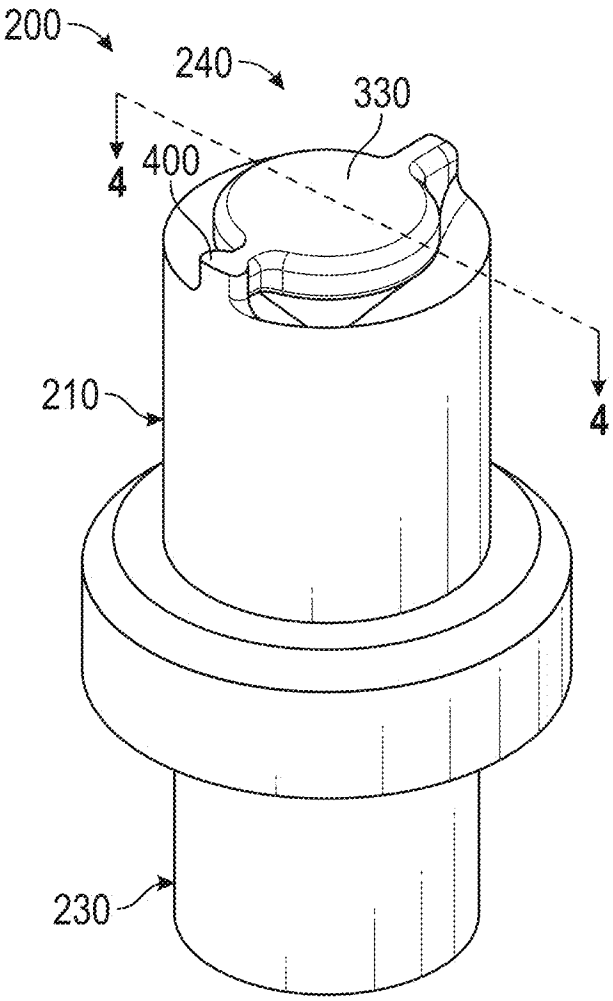
FIG. 3 is an isometric view of an evaporator header insert according to an embodiment.

As indicated, in a parallel flow passage design, under adverse gravity conditions, characteristics of the flow dynamics into the evaporator passages from the header may result in reduced contact between the working fluid and the evaporator, which may reduce effectiveness of the system. As shown in FIGS. 1 and 2, a prior art evaporator assembly 55 (FIG. 2) typically includes a plurality of inserts generally referred to as 50 (for simplicity, a single insert 50*a* is shown in FIGS. 1-2). The inserts 50 are disposed in respective ones of a plurality of outlet ports 70 (for simplicity, a single outlet port 70*a* is labeled in FIG. 2) of an evaporator header 60 (FIG. 2). An evaporator body 85 includes a plurality of evaporator passages generally referred to as 80 (for simplicity, a single evaporator passage 80*a* is labeled in FIG. 2). The evaporator passages 80 are generally parallel to one another in the evaporator body 85. Through the insert 50*a*, the outlet port 70*a* may fluidly communicate with the evaporator passage 80*a*. Heat energy 90 may be applied to either side or both sides of the evaporator body 85. To achieve uniform flow distribution in the parallel flow passages design, the insert 50*a* is commonly used to create desired back pressure at the entrance of the evaporator passage 80*a*.

Flow lines 95 shown in FIG. 2 indicate the fluid flow direction through the insert-passage 62 and inside the evaporator passage 80*a* in a microgravity environment, such as in an aerospace application. Undisturbed fluid may flow mostly in a straight line without contacting a sidewall 100 of the evaporator passage 80*a*. In order to have an efficient operation, the fluid phase of the working fluid should contact the sidewall 100 of the evaporator passage 80*a* along an entire length of the evaporator passage 80*a*. Otherwise, available heat along the full length of the sidewall 100 may remain in the evaporator body 85. This is inefficient and may result in damage to the evaporator body 85.

In view of the above identified concerns, turning to FIGS. 3-6, a header insert 200 for the evaporator header outlet port 70A is illustrated. The header insert 200 can be utilized in place of the known inserts 50 shown above in the header 60. The header insert 200 includes a header insert body 210 that extends along a body center axis 220, between a body inlet end 230 and a body outlet end 240.

The header insert body 210 includes a center passage 250 defined by a center passage surface 260 located within the header insert body 210. The center passage surface 260 extends from the body inlet end 230 to the body outlet end 240 along the body center axis 220. The center passage surface 260 defines a center passage inlet portion 270 at the body inlet end 230.

A center passage outlet portion 280 is at the body outlet end 240. The center passage outlet portion 280 defines a body nozzle portion 290 on the body center axis 220. The body nozzle portion 290 has a convergent-divergent shape, so that the body nozzle portion 290 has a convergent segment 300, a divergent segment 310A and a neck segment 320 therebetween.

A conical tip member 330 is fixed to the body outlet end 240 and disposed at least partially within the divergent segment 310A, so that a conical outlet passage 340 is formed therebetween.

A divergent segment diameter 350 is defined by the divergent segment 310A. The divergent segment diameter 350 extends to an axial outer edge 360 of the body outlet end 240. A conical tip member base portion 370 is defined by the conical tip member 330. The conical tip member base portion 370 has a base portion diameter 380 that is larger than a center passage diameter 390. The base portion diameter 380 of the conical tip member 330 is smaller than the divergent segment diameter 350. One or more runners 400 connects the conical tip member 330 to the body outlet end.

A flange 410 extends radially outwardly from the header insert 200 from a location that is axially between the body inlet end 230 and the body outlet end 240. The center passage outlet portion 280 of the center passage surface 260 is axially between the flange 410 and the body outlet end 240.

Figure 5:
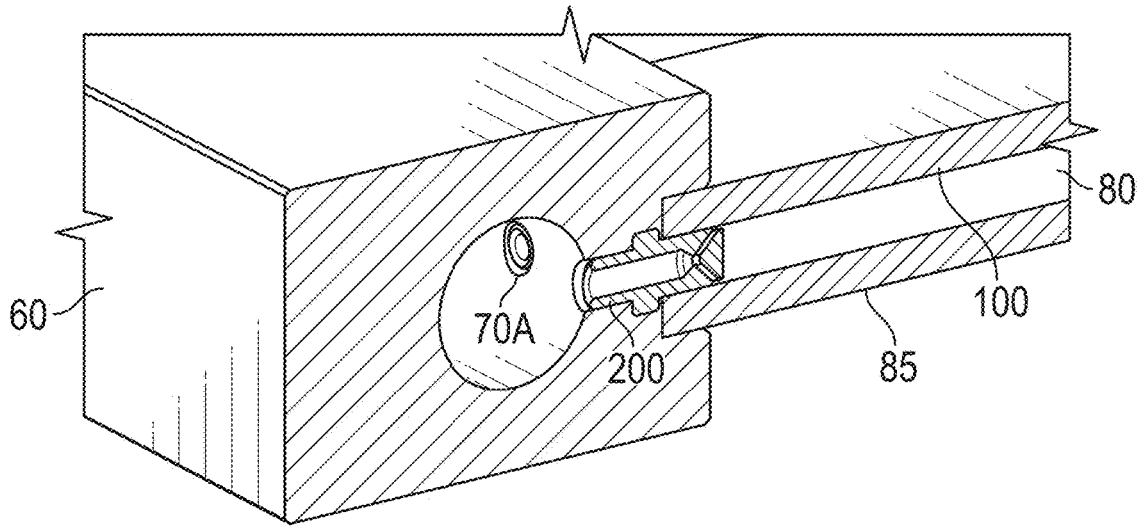
FIGS. 5 and 6 are cross sectional views of an evaporator equipped with the evaporator header insert of FIG. 3.
Figure 6:
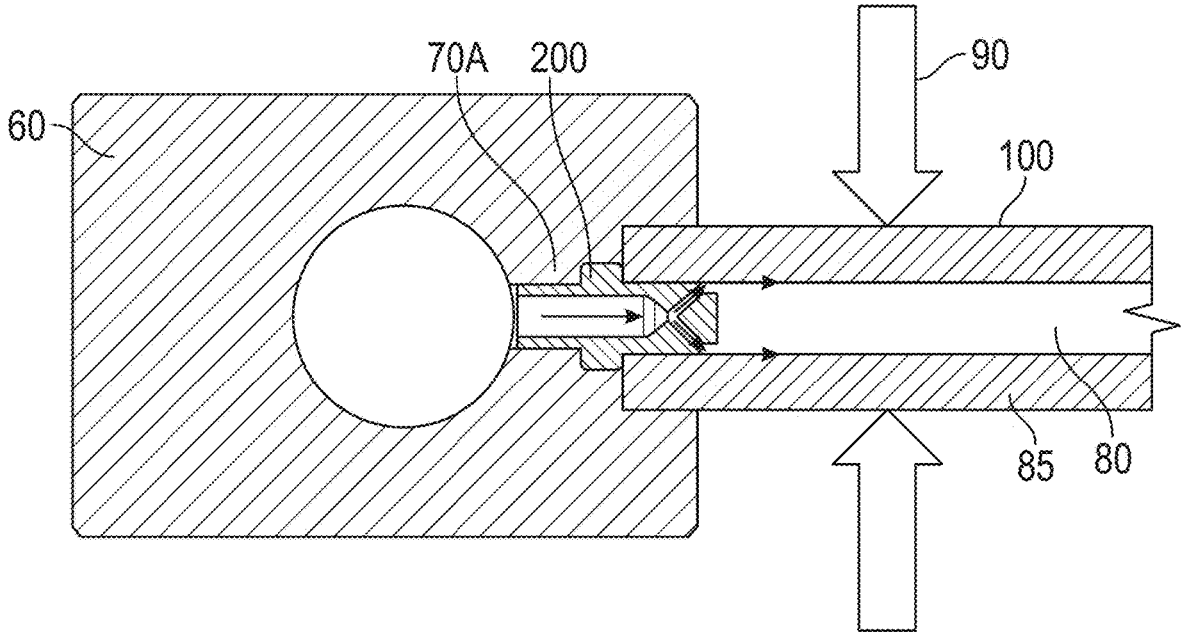

Tuning to FIGS. 5 and 6, the header insert 200 is disposed in the evaporator header outlet port 70A of the header insert 200. Flow out of the header insert 200 into the evaporator passage 80A of the evaporator body 85 flows against the sidewall 100 near the header insert 200. This improves transfer of the heat energy 90 with the evaporator passage 80A.

Figure 7:
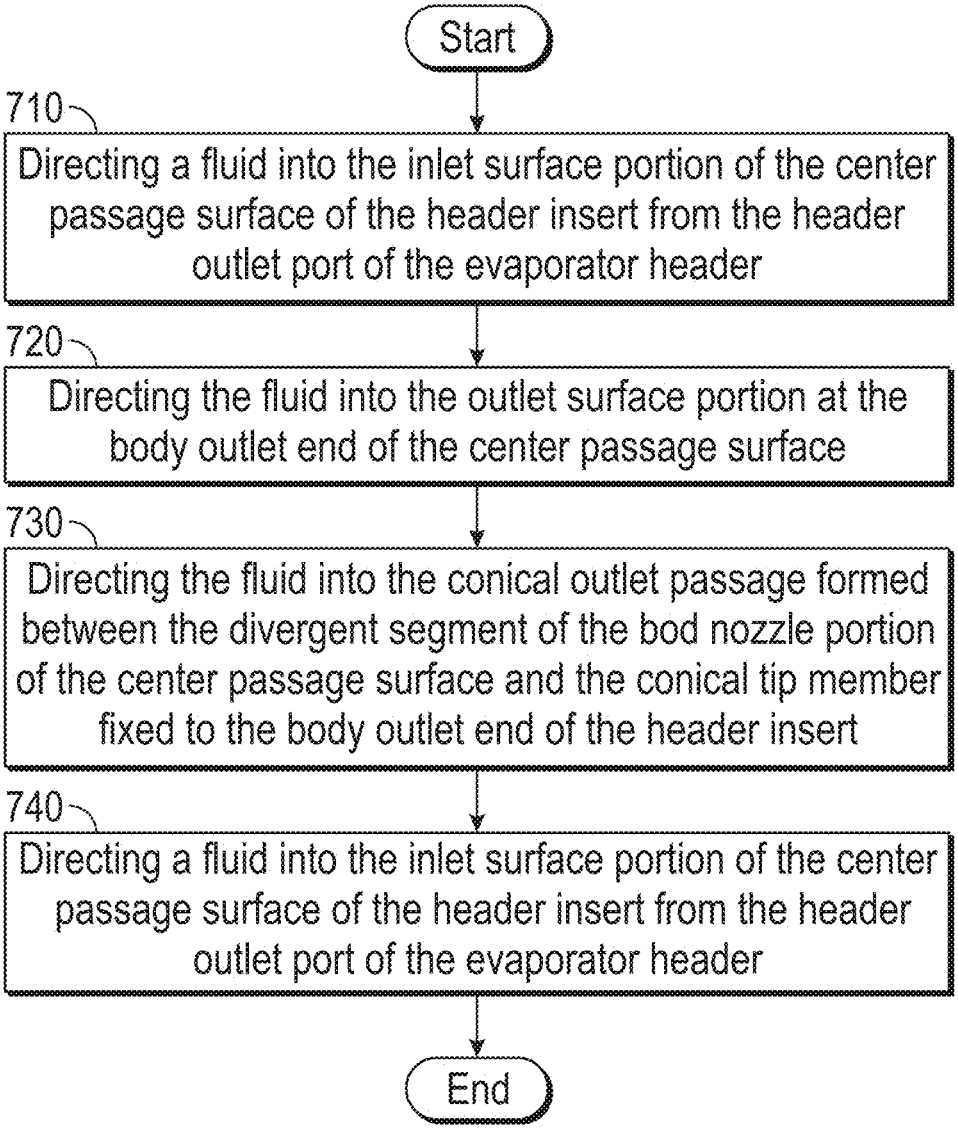
FIG. 7 is a flowchart showing a method of evaporating a single-phase liquid or two-phase fluid with an evaporator assembly.

FIG. 7 is a flowchart showing a method for directing fluid through the evaporator header 60. As shown in block 710, the method includes directing a fluid into the center passage inlet portion 270 of the center passage surface 260 of the header insert 200 from the evaporator header outlet port 70A of the evaporator header 60. As shown in block 720, the method includes directing the fluid into the center passage outlet portion 280 at the body outlet end 240 of the center passage surface 260. The center passage outlet portion 280 defines the body nozzle portion 290 on the body center axis 220. The body nozzle portion 290 has the convergent-divergent shape so that body nozzle portion 290 has the convergent segment 300, the divergent segment 310A and the neck segment 320 therebetween.

As shown in block 730, the method further includes directing the fluid into the conical outlet passage 340 formed between the divergent segment 310A of the center passage outlet portion 280 and the conical tip member 330 fixed to the body outlet end 240 of the header insert 200. As shown in block 740, the method includes directing the fluid into the evaporator passage 80A of the evaporator body 85 from the conical outlet passage 340. In the evaporator body 85, the fluid moves towards the sidewall 100 of the evaporator passage 80A as the fluid moves downstream along the evaporator passage 80A.

Figure 8:
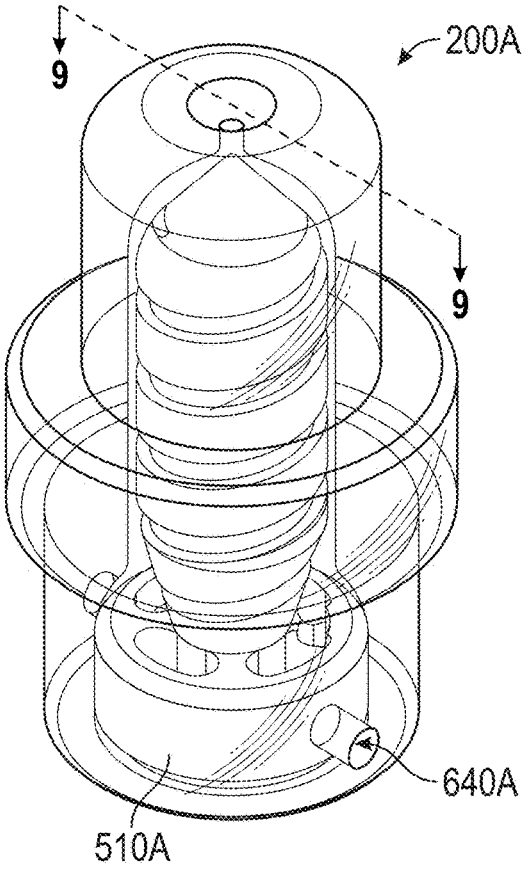
FIG. 8 is an isometric view of an insert assembly according to an embodiment.
Figure 9:
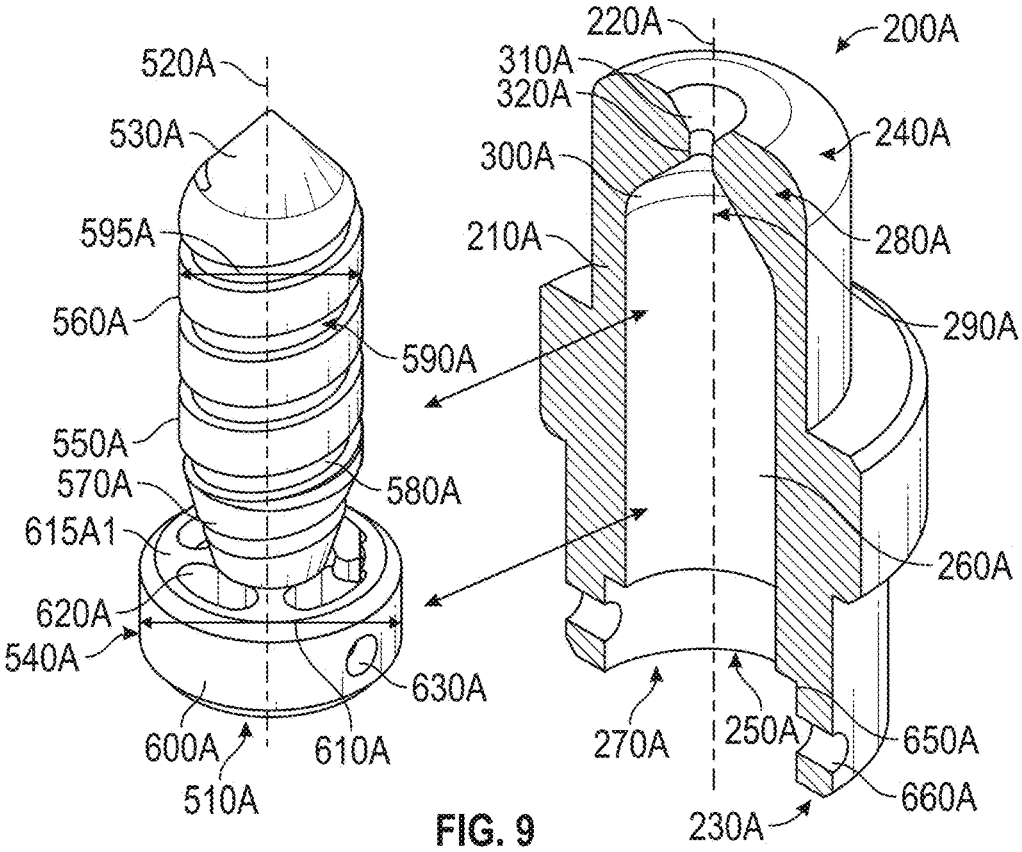
FIG. 9 is an exploded view of the insert assembly of FIG. 8, with an evaporator header insert of the insert assembly shown in cross-section along lines B-B in FIG. 8, according to an embodiment.

FIGS. 8-9 illustrate an embodiment where a header insert assembly 800 is provided. The assembly 800 includes a header insert 200A and an internal insert 500A. Terminology having reference numbers that are the same as those in the above disclosed embodiment shall be construed the same except as otherwise disclosed herein. The internal insert 510A extends along an internal insert body center axis 250A. The internal insert 510A defines an internal insert tip portion 530A, and an internal insert base portion 540A axially spaced therefrom. An internal insert center body portion 550A extends axially between the internal insert tip portion 530A and the internal insert base portion 540A.

The internal insert tip portion 530A converges away from the internal insert center body portion 550A. The internal insert center body portion 550A defines a first axial segment 560A and a second axial segment 570A extending away from one another along the axis 520A. The first axial segment 560A extends to the internal insert tip portion 530A and the second axial segment 570A extends to the internal insert base portion 540A along the axis 520A.

The first axial segment 560A of the internal insert center body portion 550A defines a first axial segment diameter 595A that is substantially constant. The second axial segment 570A of the internal insert center body portion 550A is formed to taper conically from the first axial segment 560A to the internal insert base portion 540A.

A helical fluid passage surface 580A, defining a continuous helical fluid passage 590A, is formed into the internal insert center body portion 550A. A ring segment 600A is defined by the internal insert base portion 540A. The ring segment 600A has a ring segment outer dimeter 610A that is larger than the first axial segment diameter 595A.

A plurality of ribs 615A (a rib 615A1 is labeled in FIG. 9) are formed by the internal insert base portion 540A. The plurality of ribs 615A are circumferentially spaced apart from one another and extend radially inwardly to connect the ring segment 600A and the internal insert 510A with one another. This configuration defines a plurality of fluid inlet ports 620A circumferentially spaced apart from one another. The plurality of fluid inlet ports 620A are configured to guide fluid therethrough toward the helical fluid passage surface 580A along the second axial segment 570A of the internal insert center body portion 550A.

A first radial through-hole 630A is formed through the internal insert base portion 540A. The first radial through-hole 630A is configured to receive a fixing pin 640A (illustrated schematically) for fixing the internal insert 510A to the header insert 200A.

The header insert 200A includes a header insert body 210A that extends along a body center axis 220A between a body inlet end 230A and a body outlet end 240A. The header insert body 210A includes a center passage surface 260A defining a center passage 250 that extends from the body inlet end 230A to the body outlet end 240A along the body center axis 220A. The center passage surface 260A defines a center passage inlet portion 270A at the body inlet end 230A. A center passage outlet portion 280A is defined by the center passage surface 260A at the body outlet end 240A. The center passage outlet portion 280A defines a body nozzle portion 290A on the body center axis 220A. The body nozzle portion 290A has a convergent-divergent shape so that the body nozzle portion 290A has a convergent segment 300A, a divergent segment 310A and a neck segment 320A therebetween.

The internal insert 510A is configured for being disposed within the center passage 250. In this configuration, the internal insert tip portion 530A is disposed at the convergent segment 300A of the body nozzle portion 290A and the internal insert base portion 540A is at the center passage inlet portion 270A of the center passage surface 260A.

A radial outward step 650A is formed at the body inlet end 2340A of the header insert 200A. The radial outward step 650A is configured for seating against the internal insert base portion 540A. This configuration limits axial motion of the internal insert 510A within the header insert 200A.

A second radial through-hole 660A is formed by the body outlet end 240A of the header insert 200A. When the internal insert 510A is within the header insert 200A, the first radial through-hole 630A in the internal insert 510A and the second radial through-hole 660A are aligned with one another and configured for receiving the fixing pin 640A.

A length of the internal insert 510A, along the body center axis 220A, is substantially the same as a length of the center passage 250, between the body outlet end 240A and the neck segment 320A of the body nozzle portion 290A. In one embodiment the internal insert 510A is configured for a clearance fit within the center passage 250.

Figure 10:
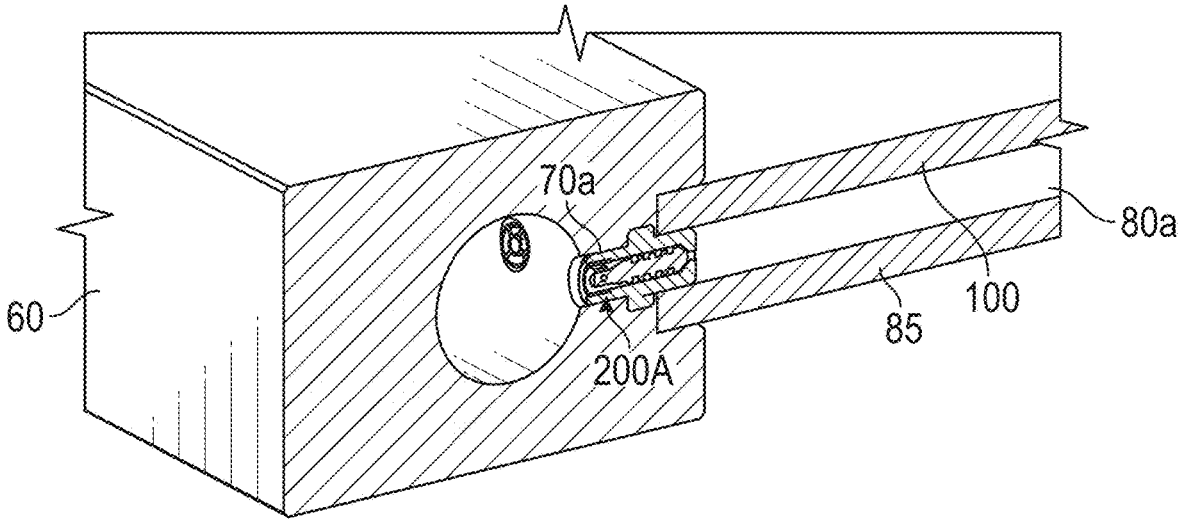
FIGS. 10 and 11 are cross sectional views of an evaporator equipped with the insert assembly of FIG. 8.
Figure 11:
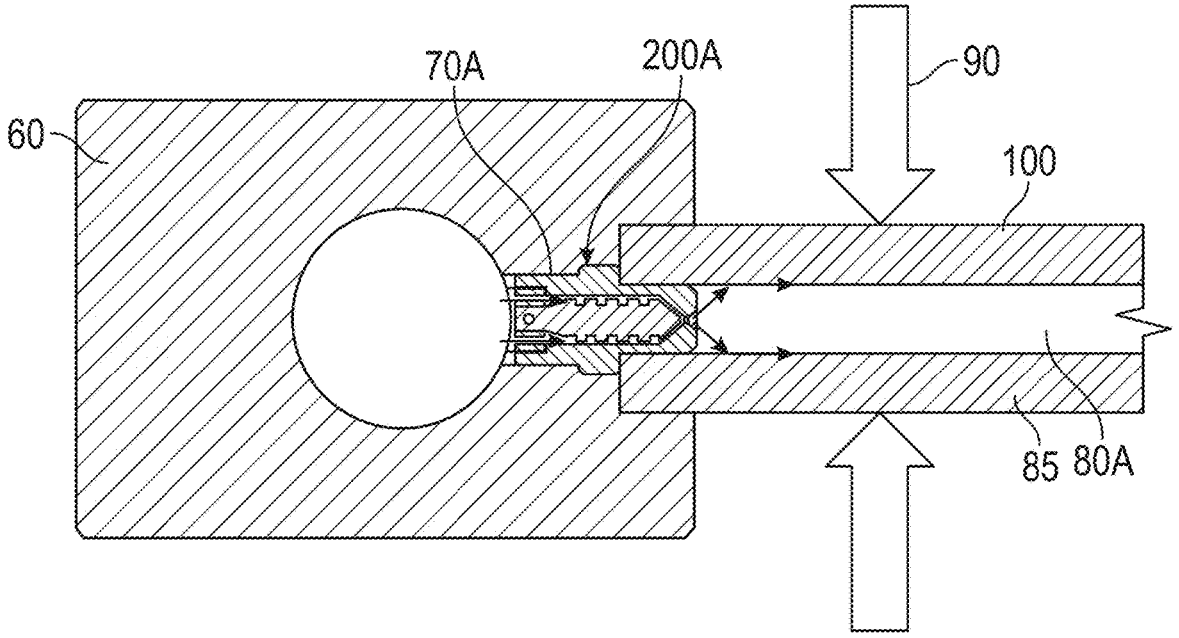

Tuning to FIGS. 10 and 11, the header insert 200A is disposed in the evaporator header outlet port 70A of the header insert 200. Flow out of the header insert 200A into the evaporator passage 80A of the evaporator body 85 flows against the sidewall 100 near the header insert 200A. This improves transfer of the heat energy 90 with the evaporator passage 80A.

Figure 12:
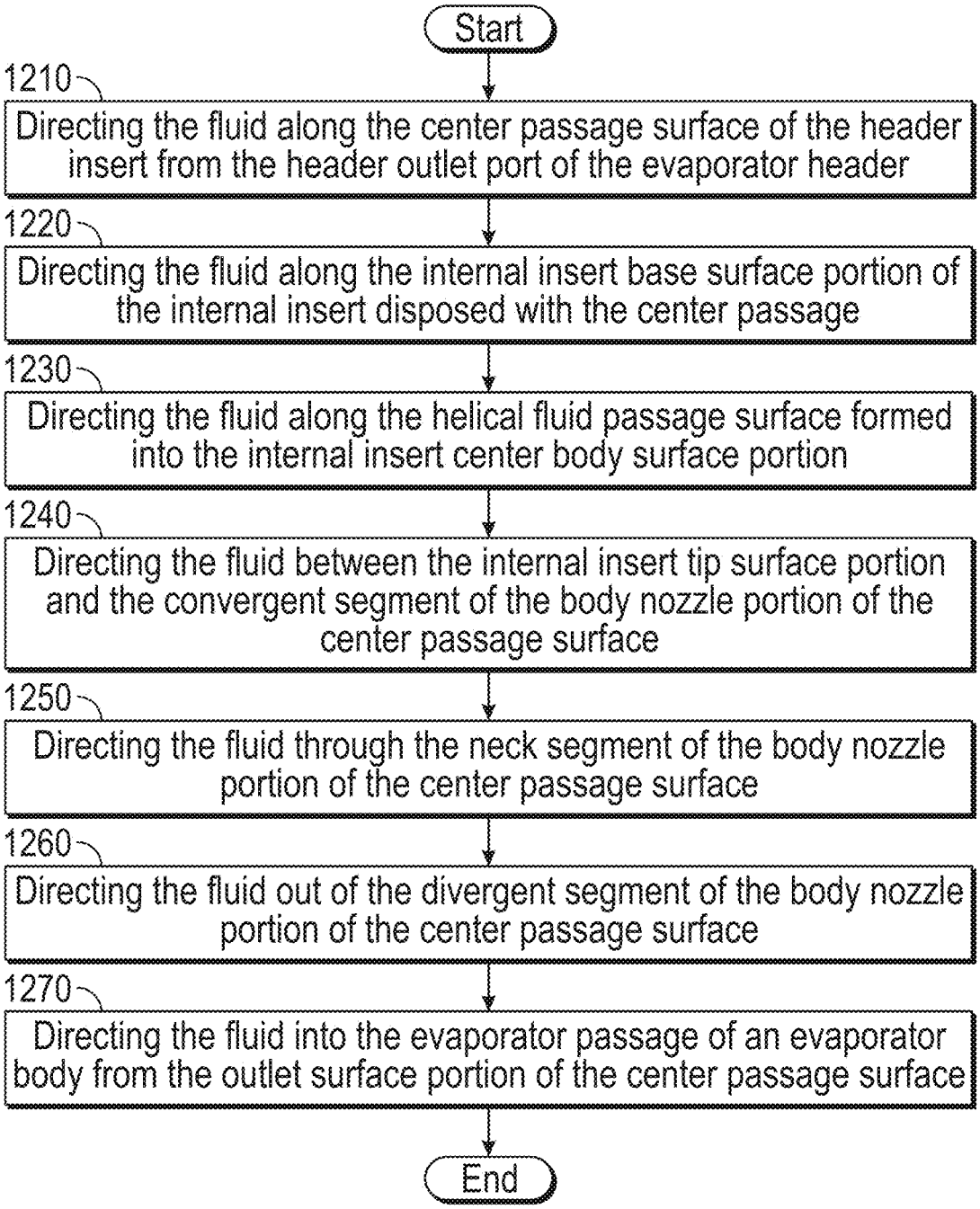
FIG. 12 is a flowchart showing another method of evaporating a single-phase liquid or two-phase fluid with an evaporator assembly.

FIG. 12 is a flowchart showing another method for directing fluid through the evaporator header 60. As shown in block 1210, the method includes directing the fluid along the center passage surface 260A of the header insert 200A from the evaporator header outlet port 70A of the evaporator header 60. As shown in block 1220, the method includes directing the fluid along the internal insert base portion 540A of the internal insert 510A disposed with the center passage 250. As shown in block 1230, the method includes directing the fluid along the helical fluid passage surface 580A formed into the internal insert center body portion 550A.

As shown in block 1240, the method includes directing the fluid between the internal insert tip portion 530A and the convergent segment 300A of the nozzle portion 290A of the center passage surface 260A. As shown in block 1250, the method includes directing the fluid through the neck segment 320A of the nozzle portion 290A of the center passage surface 260A. As shown in block 1260, the method includes directing the fluid out of the divergent segment 310A of the nozzle portion 290A of the center passage surface 260A. As shown in block 1270, the method includes directing the fluid into the evaporator passage 80A of an evaporator body 85 from the center passage outlet portion 280A of the center passage surface 260A. From this, the fluid moves towards the sidewall 100 of the evaporator passage 80A as the fluid moves downstream along the evaporator passage 80A.

In one embodiment, directing the fluid through the internal insert base portion 540A includes directing the fluid through a plurality of fluid inlet ports 620A circumferentially spaced apart from one another. The plurality of fluid inlet ports 620A are defined by the plurality of ribs 615A that are circumferentially spaced apart from one another and connect the ring segment 600A of the internal insert base portion 540A to the internal insert 510A.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An internal insert for a header insert of an evaporator header outlet port, comprising:

an internal insert tip portion that is frustoconical;

an internal insert base portion spaced along a body center axis from the internal insert tip portion; and an internal insert center body portion extending axially between the internal insert tip portion and the internal insert base portion, wherein:

the internal insert tip portion converges away from the internal insert center body portion;

the internal insert center body portion defines a first axial segment and a second axial segment extending away from one another, wherein the first axial segment extends to the internal insert tip portion and the second axial segment extends to the internal insert base portion; and a helical fluid passage surface, defining a continuous helical fluid passage, is formed into the internal insert center body portion, wherein:

the first axial segment defines a first axial segment diameter that is substantially constant and the second axial segment is formed to taper conically from the first axial segment to the internal insert base portion;

a ring segment defined by the internal insert base portion, the ring segment having a ring segment outer dimeter that is larger than the first axial segment diameter;

a plurality of ribs formed by the internal insert base portion, the plurality of ribs being circumferentially spaced apart from one another and extend radially inwardly to connect the ring segment to the internal insert, thereby defining a plurality of fluid inlet ports circumferentially spaced apart from one another, the plurality of fluid inlet ports being configured to guide fluid therethrough toward the helical fluid passage surface along the second axial segment of the internal insert center body portion.

2. The internal insert of claim 1, wherein:

a first radial through-hole is formed through the internal insert base portion, wherein the first radial through-hole is configured to receive a fixing pin for fixing the internal insert to the header insert.

3. The internal insert of claim 1 in combination with the header insert, wherein the header insert includes:

a header insert body that extends along the body center axis between a body inlet end and a body outlet end, wherein the header insert body includes a center passage surface defining a center passage that extends from the body inlet end to the body outlet end along the body center axis, the center passage surface defining:

a center passage inlet portion at the body inlet end;

a center passage outlet portion at the body outlet end, the center passage outlet portion defining a body nozzle portion on the body center axis, the body nozzle portion having a convergent-divergent shape so that the body nozzle portion has a convergent segment, a divergent segment and a neck segment therebetween;

wherein the internal insert is configured for being disposed within the center passage, so that the internal insert tip portion is disposed at the convergent segment of the body nozzle portion and the internal insert base portion is at the center passage inlet portion of the center passage surface.

4. The internal insert in combination with the header insert as recited in claim 3, wherein:

a radial outward step is formed at the body outlet inlet end of the header insert, wherein the radial outward step is configured for seating against the internal insert base portion, thereby limiting axial motion of the internal insert within the header insert.

5. The internal insert in combination with the header insert as recited in claim 3, wherein:

a second radial through-hole is formed by the body outlet end of the header insert, wherein when the internal insert is within the header insert, a first radial through-hole in the internal insert and the second radial through-hole are aligned with one another and configured for receiving a fixing pin.

6. The internal insert in combination with the header insert as recited in claim 3, wherein:

a length defined by the internal insert, along the body center axis, is substantially the same as the center passage surface, between the body outlet end and the neck segment of the body nozzle portion.

7. The internal insert in combination with the header insert as recited in claim 3, wherein the internal insert is configured for a clearance fit within the center passage.

8. The internal insert in combination with the header insert as recited in claim 3, further comprising:

an evaporator header that defines the evaporator header outlet port;

an evaporator body that defines an evaporator passage in fluid communication with the evaporator header outlet port, wherein the header insert is disposed in the evaporator header outlet port.

9. A method of directing fluid through an evaporator assembly, comprising:

directing a fluid along a center passage surface of a header insert from an evaporator header outlet port of an evaporator header;

directing the fluid along an internal insert base portion of an internal insert disposed with a center passage;

directing the fluid along a helical fluid passage surface formed into an internal insert center body portion of the internal insert, wherein:

the internal insert center body portion defines a first axial segment and a second axial segment extending away from one another, wherein the first axial segment extends to the internal insert tip portion and the second axial segment extends to the internal insert base portion, and a helical fluid passage surface, defining a continuous helical fluid passage, is formed into the internal insert center body portion, and wherein:

the first axial segment defines a first axial segment diameter that is substantially constant and the second axial segment is formed to taper conically from the first axial segment to the internal insert base portion, wherein the internal insert includes a ring segment defined by the internal insert base portion, the ring segment having a ring segment outer dimeter that is larger than the first axial segment diameter, and a plurality of ribs formed by the internal insert base portion, the plurality of ribs being circumferentially spaced apart from one another and extend radially inwardly to connect the ring segment to the internal insert, thereby defining a plurality of fluid inlet ports circumferentially spaced apart from one another, the plurality of fluid inlet ports being configured to guide fluid therethrough toward the helical fluid passage surface along the second axial segment of the internal insert center body portion;

directing the fluid between frustoconical internal insert tip portion and a convergent segment of a center passage outlet portion of the center passage surface;

directing the fluid through a neck segment of a body nozzle portion of the center passage surface;

directing the fluid out of a divergent segment of the body nozzle portion of the center passage surface; and directing the fluid into an evaporator passage of an evaporator body from the center passage outlet portion of the center passage surface, wherein the fluid moves towards a sidewall of the evaporator passage and moves downstream along the evaporator passage;

wherein directing the fluid through the internal insert base portion includes directing the fluid through the plurality of fluid inlet ports circumferentially spaced apart from one another, defined by the plurality of ribs that are circumferentially spaced apart from one another and that connect the ring segment of the internal insert base portion to the internal insert.

* * * * *